US007083111B2

(12) United States Patent
Reisher et al.

(10) Patent No.: US 7,083,111 B2
(45) Date of Patent: Aug. 1, 2006

(54) TOY VEHICLE TRACK

(75) Inventors: Dean C. Reisher, Brick, NJ (US); Gerhart P. Huy, Hamilton Square, NJ (US)

(73) Assignee: Mattel, Inc., El Segundo, CA (US)

( * ) Notice: Subject to any disclaimer, the term of this patent is extended or adjusted under 35 U.S.C. 154(b) by 0 days.

(21) Appl. No.: 10/267,702

(22) Filed: Oct. 9, 2002

(65) Prior Publication Data

US 2003/0216186 A1 Nov. 20, 2003

Related U.S. Application Data

(60) Provisional application No. 60/381,492, filed on May 17, 2002.

(51) Int. Cl.
*A63H 18/12* (2006.01)

(52) U.S. Cl. ..... 238/10 F; 238/10 E; 104/60

(58) Field of Classification Search ..... 238/10 E, 238/10 F, 10 R, 10 A, 10 B, 10 C; 463/61, 463/62, 68; 446/446; 104/53, 60; 105/1–5
See application file for complete search history.

(56) References Cited

U.S. PATENT DOCUMENTS 3,243,120 A * 3/1966 Lingard et al. ..... 238/10 R
3,830,426 A * 8/1974 Martin ..... 238/10 F
4,066,211 A * 1/1978 Mak ..... 238/10 F
4,082,220 A * 4/1978 Cheng et al. ..... 238/10 F
4,106,695 A * 8/1978 Carella et al. ..... 238/10 F
4,203,548 A * 5/1980 Cheng ..... 238/10 F
4,241,875 A * 12/1980 Vandenbrink ..... 238/10 F
4,997,187 A * 3/1991 Smollar et al. ..... 463/59
5,405,080 A * 4/1995 Yeung et al. ..... 238/10 F
5,617,996 A * 4/1997 Julve ..... 238/10 R

OTHER PUBLICATIONS

Four (4) color digital photographs of same, prior art Tyco Racing track section showing end connections.

* cited by examiner

*Primary Examiner*—Frantz F. Jules
(74) *Attorney, Agent, or Firm*—Akin Gump Strauss Hauer & Feld, LLP

(57) ABSTRACT

A toy vehicle slot track is formed from a plurality of interconnecting track segments. Each segment includes two opposing ends, each end having a pair of coupling projections intended to mate with corresponding coupling sockets on an interconnecting segment. Each end further includes at least one locking lug which in a first preferred embodiment mates with a corresponding locking tab or in a second preferred embodiment mates with a locking recess. The interconnecting track segments are thus releasably locked together by the coupling projections and coupling sockets, acting in combination with the locking lug and locking tab or recess. Each segment further includes a plurality of conductive strips partially embedded in each segment, extending between the opposing ends. At least one end portion of each one conducting strip extends beyond the end of the track segment, and is bent to wrap around the end portion of the track segment. At least one conducting strip is bent to increase the contact pressure on a conducting strip of an adjoining track segment.

30 Claims, 5 Drawing Sheets

TOY VEHICLE TRACK

This Application Claims the Benefit of Provisional Application No. 60/381,492, filed on May 17, 2002.

BACKGROUND OF THE INVENTION

The present invention relates to toy vehicle slot track, and more particularly to a toy vehicle slot track having a plurality of releasably couplable track segments with improved connections therebetween.

A variety of toy vehicle slot track constructions are known. Generally, the track construction comprises track segments or sections having one or more slots for engaging a projecting pin on a toy vehicle which guide the toy vehicle around the track. The toy vehicles are typically powered through a pair of conductors embedded in the track. The terms "segment" and "section" are used interchangeably herein.

Prior art track constructions have presented numerous problems including difficulty in assembly and disassembly, poor track connection strength, breakage of connecting parts, poor electrical connection/continuity, and poor track segment alignment which can cause a toy vehicle to get stuck or derail.

Accordingly, a slot track design is needed which allows for easy assembly and disassembly such that a child user can readily assemble, manipulate and disassemble various track configurations. The track design must also provide for secure and accurate mechanical and electrical connections so that a connection is maintained even if the assembled track is stepped on, twisted or picked up. Finally, the track design must also be sufficiently durable to withstand wear and tear from repeated assembly and disassembly, and from the tensile, compressive, bending, shear or torsional stresses which might arise during use.

BRIEF SUMMARY OF THE INVENTION

According to one aspect of the invention, a toy vehicle slot track is provided having a plurality of releasably couplable track segments. Each track segment has a pair of opposing ends, each end comprising a first coupling projection adjacent a first edge portion and a first coupling socket adjacent the first coupling projection. A second coupling socket is provided adjacent a second edge portion and a second coupling projection is provided adjacent the second coupling socket. A hooked locking tab and a locking lug are also provided. Each track segment also includes a plurality of partially embedded conductive strips. At least one end portion of at least one conducting strip has a first bend such that the end portion extends beyond and wraps around an end portion of the track segment. The at least one conducting strip has a second bend to increase the contact pressure on a conducting strip of an adjoining track segment. The first coupling projection, the first coupling socket, the second coupling projection, the second coupling socket, the hooked locking tab, the locking lug and the end portion of the conducting strip of a track segment respectively engage a second coupling socket, a second coupling projection, a first coupling socket, a first coupling projection, a locking lug, a hooked locking tab and an end portion of a conducting strip of a corresponding track segment to form a releasable locking engagement therebetween.

According to a second aspect of the invention a toy vehicle slot track is provided having a plurality of releasably couplable track segments. Each track segment has a pair of opposing ends, each end comprising a first coupling projection adjacent a first edge portion having a locking lug. A first coupling socket is provided adjacent the first coupling projection. A second coupling socket is provided adjacent a second edge portion. A second coupling projection is provided adjacent the second coupling socket having a locking recess. Each track segment also includes a plurality of partially embedded conductive strips. At least one end portion of at least one conducting strip has a first bend such that the end portion extends beyond and wraps around an end portion of the track segment. The at least one conducting strip has a second bend separate from the first bend so as to increase the lateral contact pressure on a conducting strip of an adjoining track segment.

The first coupling projection, the locking lug, the first coupling socket, the second coupling projection, the locking recess, the second coupling socket, and the end portion of the conducting strip respectively engage a second coupling socket, a locking recess, a second coupling projection, a first coupling socket, a first locking lug, a first coupling projection, and an end portion of a conducting strip of a corresponding track segment to form a releasable locking engagement therebetween.

According to yet a third aspect of the invention, a toy vehicle slot track is provided having a plurality of releasably couplable track segments. Each segment comprises an upper major planar surface and a lower major planar surface and a plurality of partially embedded conductive strips partially exposed along the upper major planar surface. Each segment further comprises first and second opposing end portions. A locking tab is integral to and extends outwardly from at least one end portion of each track segment. A hook extends upwardly from a distal end of the locking tab. A finger rib extends downwardly from the distal end of the locking tab away from the hook, and a locking lug extends downwardly from the lower major planar surface of the track segment. The hook of the locking tab and the locking lug respectively engage the locking lug and the hook of the locking tab of another of the plurality of track segments to form a releasable locking engagement therebetween.

BRIEF DESCRIPTION OF THE SEVERAL VIEWS OF THE DRAWINGS

The foregoing summary, as well as the following detailed description of preferred embodiments of the invention, will be better understood when read in conjunction with the appended drawings. For the purpose of illustrating the invention, there is shown in the drawings embodiments which are presently preferred. It should be understood, however, that the invention is not limited to the precise arrangements and instrumentalities shown. In the drawings.

DETAILED DESCRIPTION OF THE INVENTION

Figure 1:
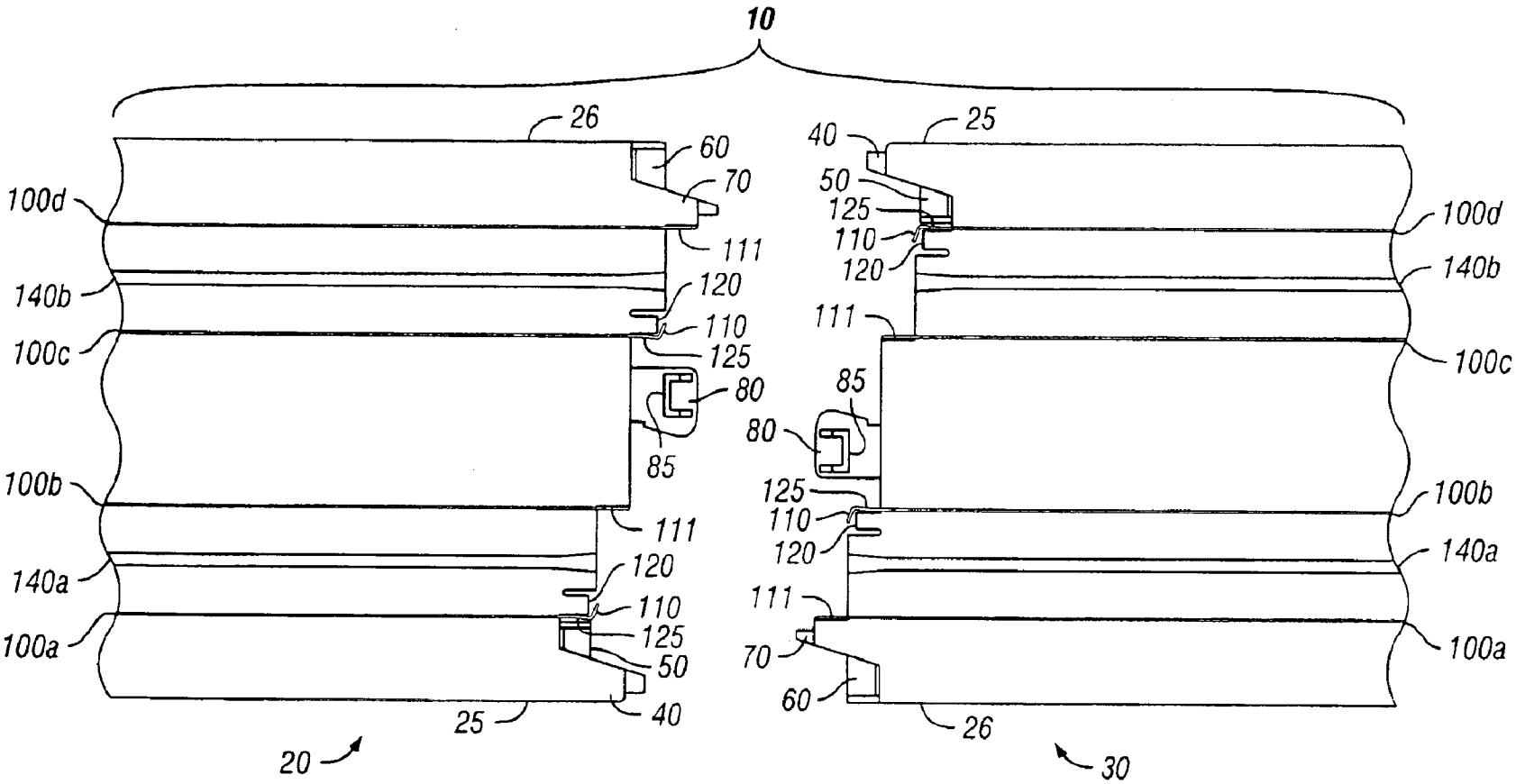
FIG. 1 is a top plan view of one embodiment of the present invention showing portions of a pair of disconnected track sections.
Figure 2:
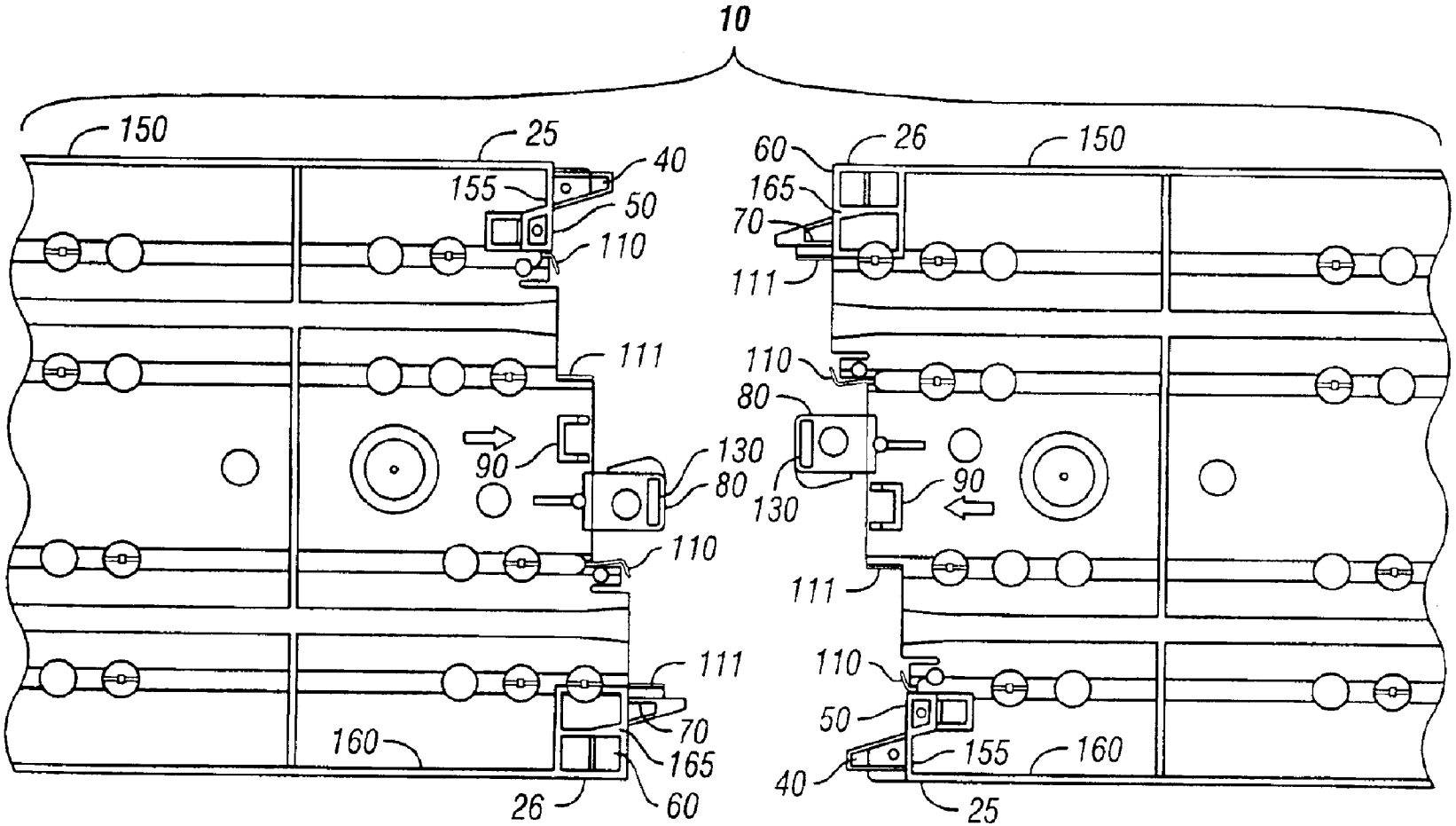
FIG. 2 is a bottom plan view of the disconnected track sections of the embodiment of FIG. 1.

Referring to FIG. 1, a pair of disconnected track segments 20, 30, preferably slot track segments, are shown having non-adjacent ends broken away. Those of ordinary skill in the art will appreciate from the Figures and the description below that each end of each track segment has connection elements arranged to allow a releasable mating engagement between track segments. The connection elements are described herein with regard to one end of each of two mating track segments 20 and 30. Although the track segments are shown as being straight, it will be understood that the track segments may be a variety of shapes including but not limited to straight, curved or S-shaped, and can be assembled in a variety of configurations to form an endless race track. It will further be appreciated that the depicted end of track segment 30 is identical to the depicted end of track segment 20 rotated 180° in the plane of FIGS. 1–4 and that the unseen ends of segments 20 and 30 are identical to the depicted ends of segments 30 and 20, respectively.

Track segments 20 and 30 are each provided with a first coupling projection 40 adjacent to a first edge portion 25. A first coupling socket 50 is positioned adjacent to the first coupling projection 40. A second coupling socket 60 is positioned adjacent to a second edge portion 26. A second coupling projection 70 is positioned adjacent to the second coupling socket 60.

The coupling projections 40, 70 and the coupling sockets 50, 60 are preferably angled or triangular in shape to allow for easy alignment of track segments during assembly.

Figure 7:
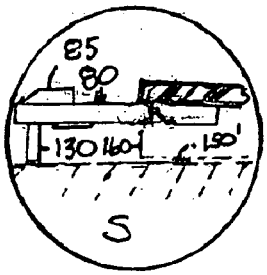
FIG. 7 is an enlarged side elevation view of one of the locking tabs of FIGS. 1 and 2.

A hooked locking tab 80 with upwardly projecting U-shaped hook 85 is preferably provided near the center of the track segments 20, 30 extending from an underside of each track segment. A locking lug 90 (shown in FIG. 2) is preferably also U-shaped and provided on a bottom side of each track segment adjacent to the hooked locking tab 80. The free outwardly extending legs of the lug 90 and hook 85 are sloped so that the hook 85 rides up and over the lug 90 when mating the sections 20, 30. The hooked locking tab 80 is preferably further provided with a downwardly projecting finger rib 130. The finger rib 130 allows for easy finger gripping and release of the hooked locking tab 80 from the locking lug 90 from the underside of the track 10 during disassembly. A diagrammatic elevation view of one of the locking tabs 80 is depicted in FIG. 7 showing the upwardly projecting, U-shaped hooked 85, and the projecting finger rib 130 extending downwardly from a distal and of the locking tab 80 and away from the hook 85 to about the same level as a bottom edge 150' (in phantom) of a side wall 160 (in phantom) and proximal to a supporting surface S (in phantom) supporting the track 10.

Preferably, the finger rib 130 is sized (i.e. has an appropriate height) to provide support for the hooked locking tabs 80 when placed on a substantially flat surface by contacting the surface or coming into contact with such surface before an engaged hook 85 and lug 90 pair are disengaged. The track 10 has to be lifted from such surface to separate the sections 20, 30. More particularly, each track segment 20, 30 preferably includes opposing lateral side walls 150, 160, which extend the full height of each track section 20, 30 and contacts any level surface supporting the track 10. Preferably too, each adjoining pair of projections and sockets 40/50 and 60/70 are supported on end walls 155 and 165, respectively, which extend down to the bottom edges of side walls 150, 160 providing uniform support along the sides and at the end corners of each track segment 20, 30. The finger rib 130 on each hooked locking tab 80 preferably extends down to the same level or at least nearly the same level as the bottom edges of walls 150, 155, 160, 165 to support the engaged tabs 80 at the centers of the mated track segments 20, 30 and prevent their disengagement by someone or something pressing down on the top side of the joint between the mated sections 20, 30 (i.e. down onto the track 10 in FIG. 3). By providing support to the hooked locking tabs 80, the finger ribs 130 help maintain a positive interlock between track segments (i.e. prevent disengagement of the hooked locking tabs 80 from the locking lugs 90) when pressure is applied to the track segments above the hooked locking tabs 80.

A plurality, in particular, two pairs of partially embedded conductive strips or rails 100*a*–*d* extend longitudinally along each track segment. One end portion 110 of each of the conducting strips 100*a*–*d* is bent so that the end portion 110 extends beyond and wraps around an end portion 120 of the track segment. The end portion 110 is preferably bent at about a 90° angle. The bend in the end portion 110 allows the end portion 110 to act as a guide for a corresponding end of a conducting strip of an adjoining track segment when connecting two track segments. The bend in the end portion 110 also prevents misalignment and possible damage to the conducting strips during the connection of track segments.

Each of the conducting strips 100*a*–*d* is preferably further bent along a second rail portion 125. The bend along the second rail portion 125 is preferably in a direction opposite to the bend in the end portion 110, and at an angle of between about 5–80°. More preferably, the bend in the second rail portion 125 is about 15°. It will be appreciated that in the depicted embodiment, each conductive strip 100*a*–*d* of each track segment 20, 30 has a straight end 111 and an end with bend portions 110, 125. Alternatively, both ends of each conductive strip 100*a*–*d* may be bent to provide locking engagement between the conductive strips of connected track segments.

It will further be appreciated that each adjoining pair of the conductive strips 100*a*/100*b* and 100*c*/100*d* flank a slot 140*a*, 140*b*, respectively, which extends along and into the upper surface of each track segment 20, 30 and aligns with a respective slot on each other mating track segment to guide a toy vehicle powered by the conductive strips 100*a*–*d* around the track 10.

The bends in the end portion 110 and the second rail portion 125 provide a number of benefits with regard to the electrical and mechanical connection between adjoining track segments. Specifically, the bends in the end portion 110 and the second rail portion 125 cause the end portion 110 and the second rail portion 125 to flex like a spring and provide locking pressure against a corresponding flat portion 111 of an adjoining conducting strip when two track segments are connected. The locking pressure maintains proper electrical continuity between adjoining conducting strips and provides a tighter track connection. The locking pressure also causes the bend in the end portion 110 to act like a wiping device against the flat portion 111 of an adjoining conducting strip to keep the ends of the conducting strips 100*a*–*d* clean of minor debris and oxidation.

When track segments are assembled, the first coupling projection 40, the first coupling socket 50, the second coupling projection 70, the second coupling socket 60, the hooked locking tab 80, the locking lug 90, and the end portion 110 or 111 of each conducting strip respectively engage a second coupling socket 60, a second coupling projection 70, a first coupling socket 50, a first coupling projection 40, a locking lug 90, a hooked locking tab 80 and end portion 111 and 125, respectively, of a conducting strip of a corresponding track segment to form a releasable locking engagement therebetween. It will be appreciated that to accomplish this, the respective pairs of mating elements, i.e. 40/60, 50/70, 110/111 and 85/90 are symmetrically positioned at each matable end of each segment of track 10 on opposite lateral sides of a longitudinal center line 10*a* (FIGS. 3 and 4) extending along track 10 and through each segment e.g. 20, 30.

Figure 3:
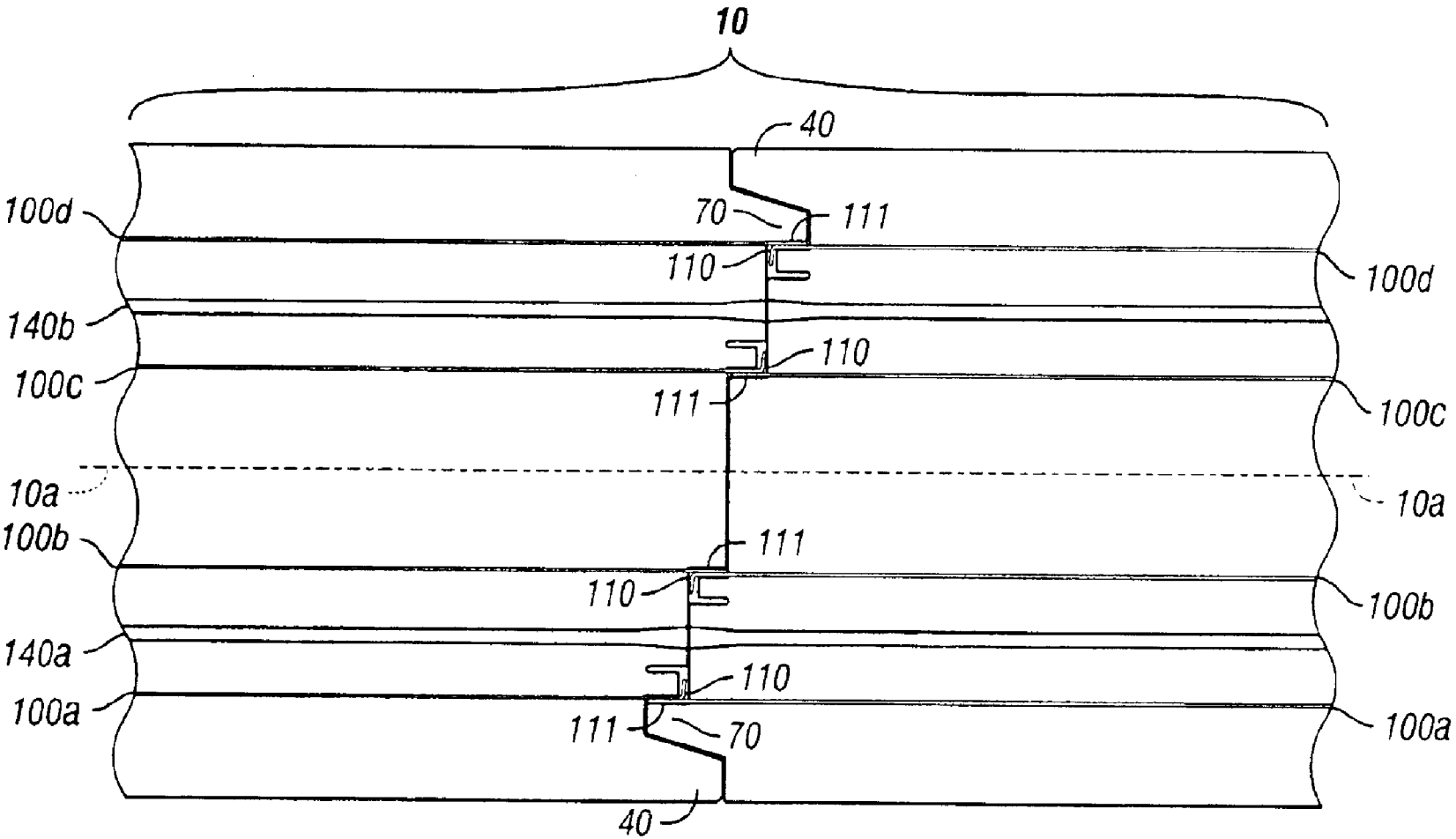
FIG. 3 is a top plan view of the track sections of the embodiment of FIGS. 1 and 2 shown in assembled relation.
Figure 4:
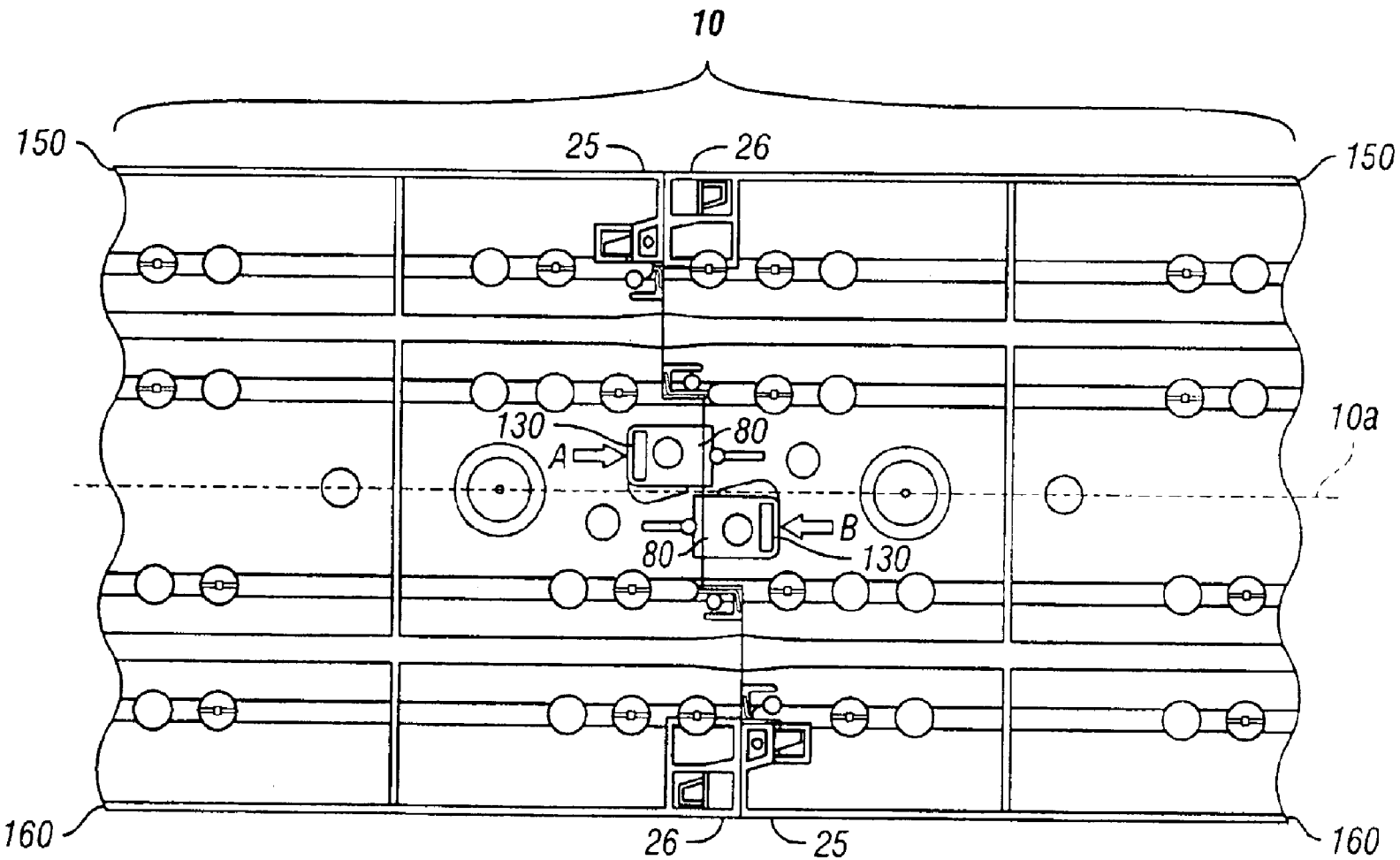
FIG. 4 is a bottom plan view of the track sections of the embodiment of FIGS. 1–3 shown in assembled relation.

FIGS. 3 and 4 show the track segments 20, 30 in an assembled relation. As can be seen in FIG. 4, the hooked locking tabs 80 engage the locking lugs 90 to provide locking engagement of the track segments. The track segments 20, 30 are readily disengageable by application of longitudinal force in directions A–B on finger ribs 130 and hooked locking tabs 80.

The connection between the track segments 20, 30 provides sufficient strength and rigidity to maintain the electrical and mechanical connection, and the proper track alignment between the track segments 20, 30. The connection is maintained under reasonable loads regardless of whether the track segments 20, 30 are placed on a non-uniform surface, are angled along a banked curve, or are twisted into a non-planar configuration.

Figure 5:
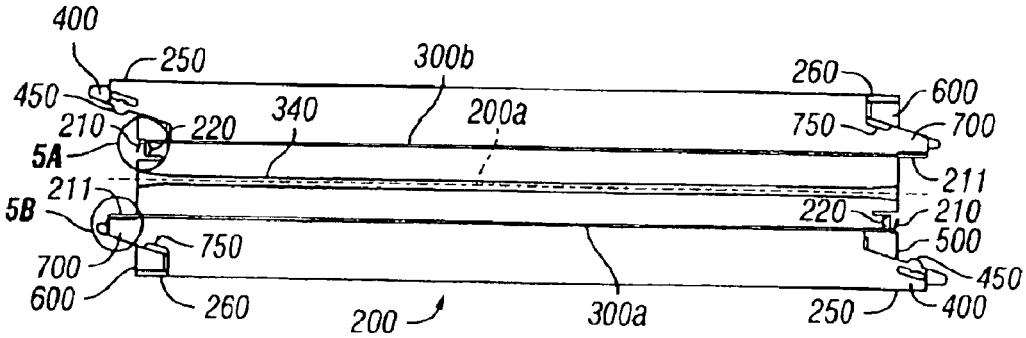
FIG. 5 is a top plan view of a track section according to a second embodiment of the present invention.
Figure 5A:
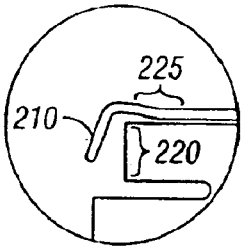
FIGS. 5*a* and 5*b* are enlarged views of portions of FIG. 5.
Figure 5B:
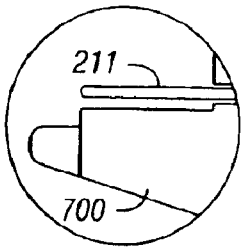
Figure 6:
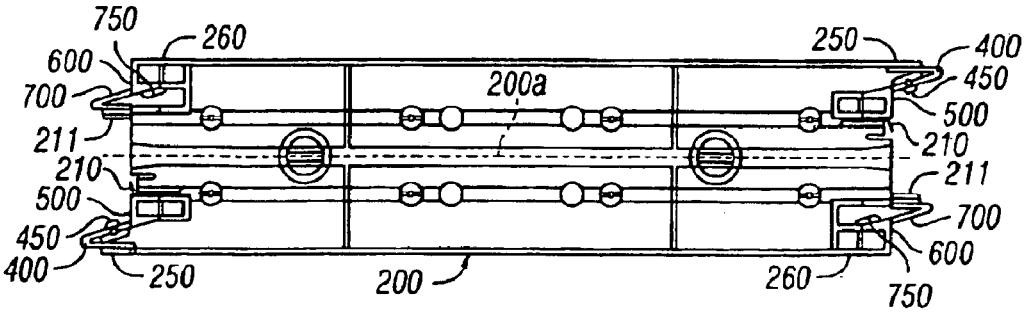
FIG. 6 is a bottom plan view of the embodiment of FIG. 5.

An alternative embodiment of the present invention is shown in FIGS. 5 and 6. Those of ordinary skill in the art will appreciate that the single lane straight track segment 200 shown in FIGS. 5 and 6 and discussed below can alternatively be formed in a variety of shapes including curved or S-shaped, and can be assembled end to end in a variety of configurations to form an endless race track.

The track segment 200 is provided on each end with a first coupling projection 400 adjacent to a first edge portion 250. The first coupling projection 400 has a locking lug 450 thereon. A first coupling socket 500 is provided adjacent to the first coupling projection 400. A second coupling socket 600 is provided adjacent to a second edge portion 260. A second coupling projection 700 is provided adjacent to the second coupling socket 600 and has a locking recess 750 therein.

The coupling projections 400, 700 and the coupling sockets 500, 600 are preferably angled or generally triangular in shape to allow for easy alignment of track segments during track assembly.

The track segment 200 includes a plurality of partially embedded conductive strips 300*a–b*. One end portion 210 of each of the conducting strips 300*a–b* is bent so that the end portion 210 extends beyond and wraps around an end portion 220 of the track segment. The end portion 210 like end portion 110 of the first embodiment is preferably bent at about a 90° angle. The bend in the end portion 210 allows the end portion 210 to act as a guide for a corresponding end of a conducting strip of an adjoining track segment when connecting two track segments. The bend in the end portion 210 also prevents misalignment and possible damage to the conducting strips during the connection of track segments.

Each of the conducting strips 300*a–b* is preferably further bent along a second rail portion 225. The bend along the second rail portion 225 like the second end portion 125 of the first embodiment is preferably in a direction opposite to the bend in the end portion 210 and at an angle of between about 5–80°, more preferably, about 15°. Alternatively, both ends of each conductive strip 300*a–b* may be bent to provide locking engagement between the conductive strips of connected track segments.

Again, a slot 340 extends between the longitudinal, matable ends of segment 200 and is centered between conductive strips 300*a*, 300*b* and along a longitudinal center line 200*a* of the segment 200. Again, it will be appreciated that each longitudinal end of track segment 200 is identical to the other, opposing longitudinal end of the segment but rotated 180° in the planes of FIGS. 5 and 6 and that mating elements 400/600, 500/700, 210/211 and strips 300*a*/300*b* are symmetrically positioned at each matable end of each track segment on opposite lateral sides of longitudinal center line 200*a* (FIGS. 5 and 6), which extends along each track segment 200, etc. preferably centered between the single set of conductive strips 300*a*, 300*b*.

The bends in the end portion 210 and the second rail portion 225 provide a number of benefits with regard to the electrical and mechanical connection between adjoining track segments. Specifically, the bends in the end portion 210 and the second rail portion 225 cause the end portion 210 and the second rail portion 225 to flex like a spring and provide locking pressure against a corresponding flat portion 211 of an adjoining conducting strip when two track segments are connected. The locking pressure maintains proper electrical continuity between adjoining conducting strips and provides a tighter track connection. The locking pressure also causes the bend in the end portion 210 to act like a wiping device against the flat portion 211 of an adjoining conducting strip to keep the ends of the conducting strips 300*a–b* clean of minor debris and oxidation.

When two track segments are assembled, the first coupling projection 400, the locking lug 450, the first coupling socket 500, the second coupling projection 700, the locking recess 750, the second coupling socket 600, and the end portion of the conducting strip 210 respectively engage a second coupling socket 600, a locking recess 750, a second coupling projection 700, a first coupling socket 500, a first locking lug 450, a first coupling projection 400, and flat end portion 211 of a conducting strip of a corresponding track segment to form a releasable locking engagement therebetween.

The connection between multiple track segments 200 provides sufficient strength and rigidity to maintain the electrical and mechanical connection, and proper track alignment between the track segments 200. The connection is maintained regardless of whether the track segments 200 are-placed on a non-uniform surface, are angled along a banked curve, or are twisted into a non-planar configuration. The track segments 200 are disengageable by application of opposing longitudinal forces on adjoining track segments in excess of the normal longitudinal forces applied to the track segments 200 which arise during use (e.g. when assembled track segments 200 are stepped on, twisted or picked up).

It will be appreciated by those skilled in the art that changes could be made to the embodiments described above without departing from the broad inventive concept thereof. It is understood, therefore, that this invention is not limited to the particular embodiments disclosed, but it is intended to cover modifications within the spirit and scope of the present invention.

We claim:

1. A toy vehicle track having a plurality of releasably couplable track segments, each segment having a pair of opposing ends, each end comprising:

a first coupling projection adjacent a first edge portion;

a first coupling socket adjacent the first coupling projection;

a second coupling socket adjacent a second edge portion;

a second coupling projection adjacent the second coupling socket;

a hooked locking tab;

a locking lug; and a plurality of partially embedded conductive strips, at least one end portion of at least one of the conducting strips having a first bend such that the end portion extends beyond and wraps around an end portion of the track segment, and wherein the at least one end portion of the at least one conducting strip has a second bend to increase lateral contact pressure exerted by that conducting strip on a conducting strip of an adjoining track segment;

wherein the first coupling projection, the first coupling socket, the second coupling projection, the second coupling socket, the hooked locking tab, the locking lug and the end portion of the at least one conducting strip of each end is configured to respectively engage the second coupling socket, the second coupling projection, the first coupling socket, the first coupling projection, the locking lug, the hooked locking tab and the end portion of one of the conducting strips of each of the pair of ends of each other track segment of the plurality to form a releasable locking engagement therebetween.

2. The toy vehicle track of claim 1 wherein each of the partially embedded conductive strips of the track segment has at least one end portion having a first bend such that the end portion extends beyond and wraps around an end portion of the track segment, and wherein the at least one end portion of each conducting strip has a second bend to increase lateral contact pressure on one of the conducting strips of the adjoining track segment of the plurality in lockable engagement therewith.

3. The toy vehicle track of claim 1 wherein the first bend is positioned at a most distal end of the strip and forms an angle of approximately ninety degrees to a direction of the conductive strip immediately inwardly adjoining the most distal end to obtain the wrap around the end portion of the track segment.

4. The toy vehicle track of claim 3 wherein the second bend is positioned inward of the most distal end of the strip in a direction opposite the bend of the most distal end of the strip and forms an angle of between five and eighty degrees away from a direction of an immediately inwardly adjoining portion of the strip embedded in the track segment to obtain the increase in lateral contact pressure.

5. The toy vehicle track of claim 1 wherein the second bend in the at least one end portion of the at least one of the plurality of partially embedded conductive strips is at an angle of between five and eighty degrees away from a direction of an immediately inwardly adjoining portion of the strip embedded in the track segment to obtain the increase in lateral contact pressure.

6. The toy vehicle track of claim 1, wherein the second bend forms an angle with an immediately inwardly adjoining portion of the strip embedded in the track segment.

7. The toy vehicle track of claim 1, wherein the first bend extends a terminal end of the at least one conductive strip in a first direction, and the second bend extends a portion of the conductive strip intermediate the first and second bends in a second direction opposite the first direction.

8. The toy vehicle track of claim 1, wherein the first bend extends a terminal end of the at least one conductive strip toward one of the first edge and the second edge, and the second bend extends a portion of the conductive strip intermediate the first and second bends toward the other of the first edge and the second edge.

9. The toy vehicle track of claim 1, wherein the end portion of the conducting strip of the adjoining track segment engaging the end portion of the at least one conducting strip is substantially unbent.

10. The toy vehicle track of claim 1, wherein each partially embedded conductive strip has a first end portion extending from one end of the track segment and having the first bend and the second bend and a substantially unbent second end portion extending from an end of the track segment opposite the one end, and wherein with adjoining track segments in releasable locking engagement, the first end portion of each conductive strip of a first track segment presses against the second end portion of each conductive strip of a second track segment.

11. The toy vehicle track of claim 10, wherein the second end portion of each conductive strip of the first track segment presses against the first end portion of each conductive strip of the second track segment.

12. A toy vehicle track having a plurality of releasably couplable track segments, each segment having a pair of opposing ends, each end comprising:

a first coupling projection adjacent a first edge portion having a locking lug;

a first coupling socket adjacent the first coupling projection;

a second coupling socket adjacent a second edge portion;

a second coupling projection adjacent the second coupling socket having a locking recess;

a plurality of partially embedded conductive strips, at least one end portion of at least one of the conducting strips having a first bend such that the end portion extends beyond and wraps around an end portion of the track segment, and wherein the at least one end portion of the at least one of the conducting strips has a second bend separate from the first bend so as to increase lateral contact pressure on a conducting strip of an adjoining track segment;

wherein the first coupling projection, the locking lug, the first coupling socket, the second coupling projection, the locking recess, the second coupling socket, and the end portion of the at least one conducting strip of each end is configured to respectively engage the second coupling socket, the locking recess, the second coupling projection, the first coupling socket, the first locking lug, the first coupling projection, and the end portion of one of the conducting strips of the end of an adjoining track segment of the plurality to form a releasable locking engagement therebetween.

13. The toy vehicls track of claim 12 wherein each of the partially embedded conductive strips of the track segment has at least one end portion bent such that the end portion extends beyond and wraps around an end portion of the track segment, and wherein the at least one end portion of each of the conducting strips is further bent to increase lateral contact pressure on one of the conducting strips of the adjoining track segment of the plurality in releasable locking engagement therewith.

14. The toy vehicle track of claim 12 wherein the first bend is positioned at a most distal end of the strip at an angle of approximately ninety degrees to a direction of the conductive strip immediately inwardly adjoining the most distal end to obtain the wrap around the end portion of the track segment.

15. The toy vehicle track of claim 14 wherein the second bend is positioned inward of the most distal end of the strip in a direction opposite the bend of the most distal end of the strip and forms an angle of between five and eighty degrees away from a direction of an immediately inwardly adjoining portion of the strip embedded in the track segment to obtain the increase in lateral contact pressure.

16. The toy vehicle track of claim 12 wherein the at least one end portion of the at least one of the plurality of partially embedded conductive strips has a bend with an angle of between five and eighty degrees away from a direction of an immediately inwardly adjoining portion of the strip embedded in the track segment to obtain the increase in lateral contact pressure.

17. The toy vehicle track of claim 12, wherein the second bend forms an angle with an immediately inwardly adjoining portion of the strip embedded in the track segment.

18. The toy vehicle track of claim 12, wherein the first bend extends a terminal end of the at least one conductive strip in a first direction, and the second bend extends a portion of the conductive strip intermediate the first and second bends in a second direction opposite the first direction.

19. The toy vehicle track of claim 12, wherein the first bend extends a terminal end of the at least one conductive strip toward one of the first edge and the second edge, and the second bend extends a portion of the conductive strip intermediate the first and second bends toward the other of the first edge and the second edge.

20. The toy vehicle track of claim 12, wherein the end portion of the conducting strip of the adjoining track segment engaging the end portion of the at least one conducting strip is substantially unbent.

21. The toy vehicle track of claim 20, wherein the second end portion of each conductive strip of a first track segment presses against the first end portion of each conductive strip of the second track segment.

22. The toy vehicle track of claim 12, wherein each partially embedded conductive strip has a first end portion having the first bend and the second bend and a substantially unbent second end portion, and wherein with adjoining track segments in releasable locking engagement, the first end portion of each conductive strip of a first track segment presses against the second end portion of each conductive strip of a second track segment.

23. A toy vehicle track having a plurality of releasably couplable track segments, each segment comprising:

an upper major planar surface and a lower major planar surface;

a plurality of partially embedded conductive strips partially exposed along the upper major planar surface;

first and second opposing end portions;

a locking tab integral to and extending outwardly from at least one end portion of each track segment; a hook extending upwardly from a distal end of the locking tab;

a finger rib extending downwardly from the distal end of the locking tab away from the hook; and a locking lug extending downwardly from the lower major planar surface of the track segment;

wherein the hook of the locking tab and the locking lug respectively engage the locking lug and the hook of the locking tab of another of the plurality of track segments to form a releasable locking engagement therebetween.

24. The toy vehicle track of claim 23 wherein the locking tab and the locking lug extend from an underside of each track segment on opposite lateral sides of a center line of the track segment.

25. The toy vehicle track of claim 23 wherein portions of the locking tab and the locking lug are sloped so that the locking tab rides up and over the locking lug when mating track segments.

26. The toy vehicle track of claim 23 further comprising side walls extending downwardly from each track segment to provide substantially uniform support for the track segment, wherein the finger rib extends downwardly from the locking tabs to about the same level as a bottom edge of the side walls to provide support for the locking tabs and prevent disengagement of the locking tabs from the locking lugs.

27. The toy vehicle track of claim 23 wherein the finger ribs extend downwardly from the locking tabs to contact a supporting surface of the track segments to maintain a positive interlock between track segments when pressure is applied to the track segments above the locking tabs.

28. The toy vehicle track of claim 23 wherein the locking tab and the finger rib form a gripping surface for disengaging the locking tab from the locking lug by applying a substantially longitudinal force on the locking tab and the finger rib.

29. A toy vehicle track having a plurality of track segments capable of releasable locking engagement, each segment comprising a plurality of partially embedded conductive strips, each conductive strip having:

a first end portion including a first bend such that the first end portion extends beyond and wraps around an end portion of the track segment, and a second bend separate from the first bend making an angle with an immediately inwardly adjoining portion of the conductive strip, and a substantially unbent second end portion, wherein with adjoining track segments in releasable locking engagement, the first end portion of each conductive strip of a first track segment presses against the second end portion of each conductive strip of a second track segment.

30. A toy vehicle track having a plurality of track segments capable of releasable locking engagement, each segment comprising a plurality of partially embedded conductive strips, each conductive strip having:

an exposed first end portion extending from a first end of the track segment, the first end portion including a first bend such that the first end portion extends beyond and wraps around a portion of the first end of the track segment, and a second bend separate from and in a direction opposite from the first bend, the second bend making an angle with an immediately inwardly adjoining embedded portion of the conductive strip, and an exposed, substantially unbent second end portion extending from a second end of the track segment opposite the first end, the second end portion having a terminal end most distant from a proximal embedded portion of the conductor, wherein with adjoining track segments in releasable locking engagement, at least the first bend of the first end portion of each conductive strip of a first track segment operatively engages the second end portion of each conductive strip of a second track segment at a point between the terminal end and the proximal embedded portion of the conductor to establish electrical contact between the first end portion and the second end portion.

* * * * *